US006846122B1

(12) United States Patent
Liao

(10) Patent No.: US 6,846,122 B1
(45) Date of Patent: Jan. 25, 2005

(54) WHITE BOARD MARKER

(76) Inventor: Chun-Ching Liao, No. 14, Lane 332, Sec. 2, Donghsing Rd., Taichung (TW)

( * ) Notice: Subject to any disclaimer, the term of this patent is extended or adjusted under 35 U.S.C. 154(b) by 0 days.

(21) Appl. No.: 10/772,387

(22) Filed: Feb. 6, 2004

(51) Int. Cl.[7] ..... B43K 23/02; B43K 5/00
(52) U.S. Cl. ..... 401/131; 401/198; 401/202
(58) Field of Search ..... 401/131, 195–207, 401/52

(56) References Cited

U.S. PATENT DOCUMENTS 2,529,764 A * 11/1950 Dufilho ..... 33/348
5,674,104 A * 10/1997 Ohashi et al. ..... 446/132
5,735,621 A * 4/1998 Shih ..... 401/52
5,927,888 A * 7/1999 Toyama ..... 401/202
6,488,429 B2 * 12/2002 Korper ..... 401/186

* cited by examiner

*Primary Examiner*—David J. Walczak
(74) *Attorney, Agent, or Firm*—Dennison, Schultz, Dougherty & MacDonald

(57) ABSTRACT

A white board marker has a cover, a body, a marker nib, an ink pad, a cap and a magnet. The magnet is mounted inside the body and attaches the white board marker to a white board. Furthermore, the cap may have multiple optional air passages through which air can pass.

3 Claims, 4 Drawing Sheets

WHITE BOARD MARKER

BACKGROUND OF THE INVENTION

1. Field of Invention

The present invention relates to a white board marker, more particularly to a bowling pin shaped white board marker.

2. Description of the Related Art

With reference to FIG. 4, a conventional white board marker (30) has a cylindrical body and is placed directly on a white board tray without being attached to the white board or the tray. The conventional white board marker slides or rolls out of the white board tray and is lost.

The present invention provides a white board marker to mitigate or obviate the aforementioned problems.

SUMMARY OF THE INVENTION

An objective of the present invention is to provide a white board marker that will attach to the white board or the white board tray.

To achieve the objective, the white board marker has a cover, a body, a marker nib, an ink pad, a cap and a magnet. The magnet is mounted inside the body and attaches the white board marker to a white board. Furthermore, the cap has multiple optional air passages.

Other objectives, advantages and novel features of the invention will become more apparent from the following detailed description when taken in conjunction with the accompanying drawings.

DETAILED DESCRIPTION OF THE INVENTION

Figure 1:
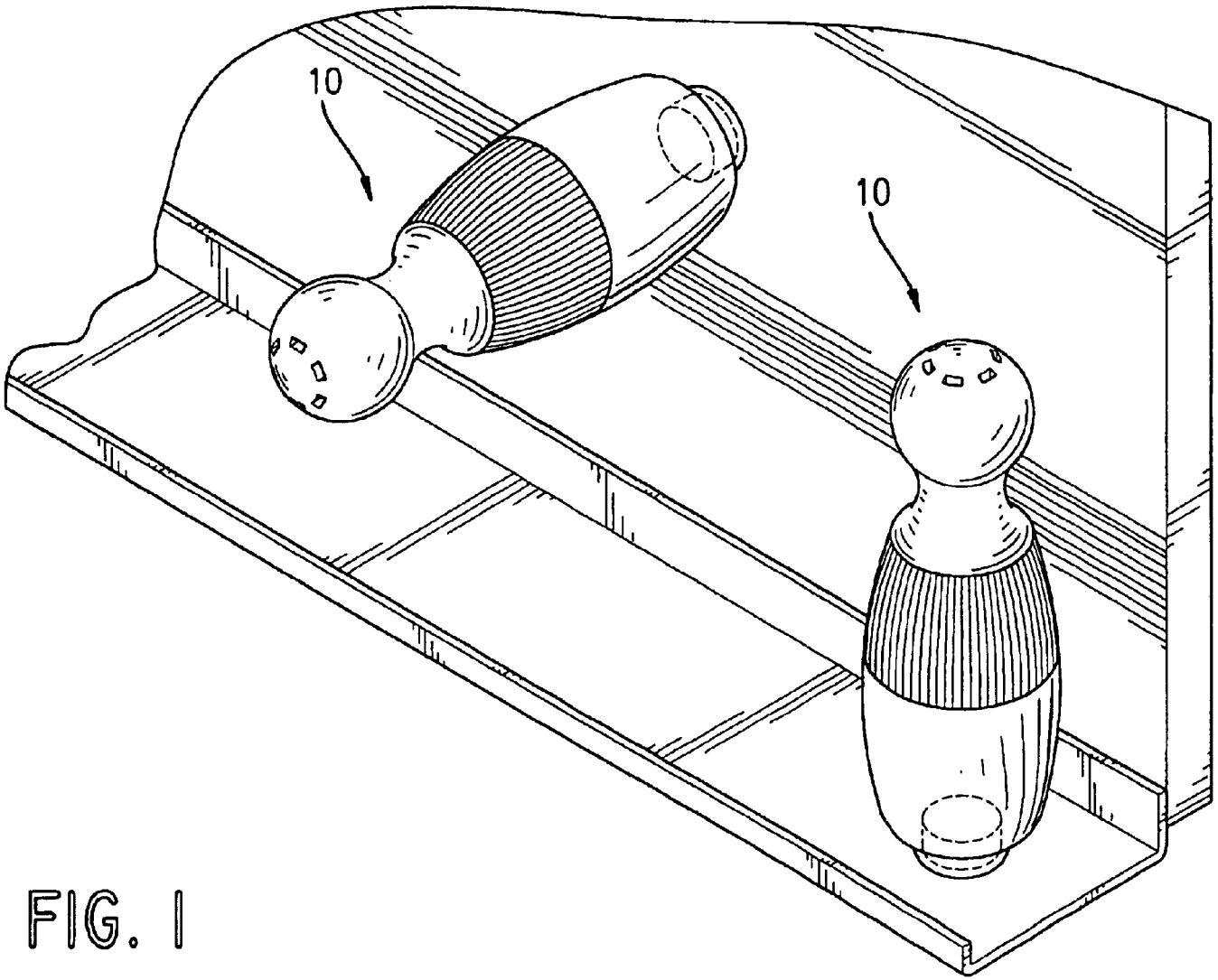
FIG. 1 is a perspective view of a white board marker in accordance with the present invention.
Figure 2:
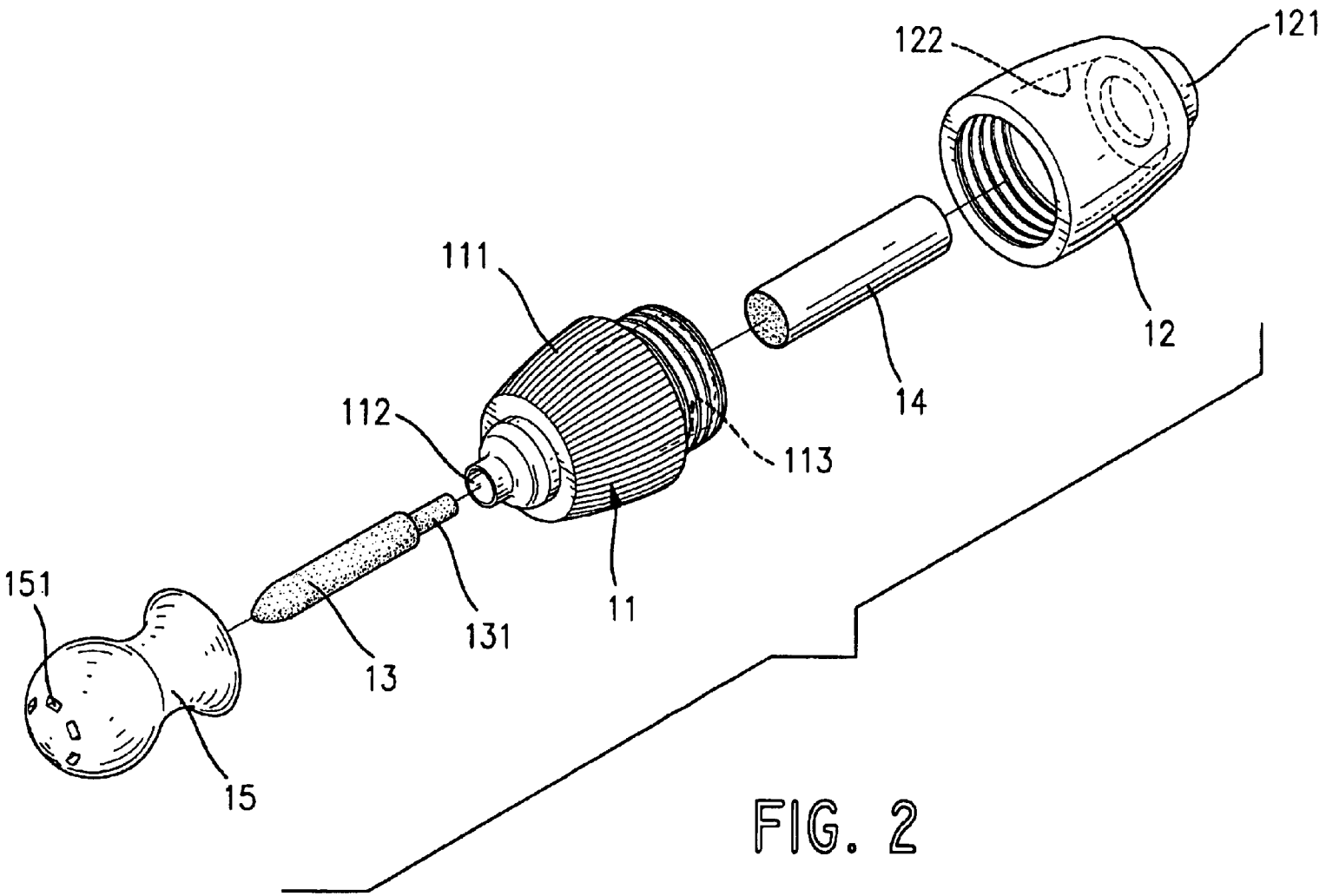
FIG. 2 is an exploded perspective view of the white board marker in FIG. 1.
Figure 3:
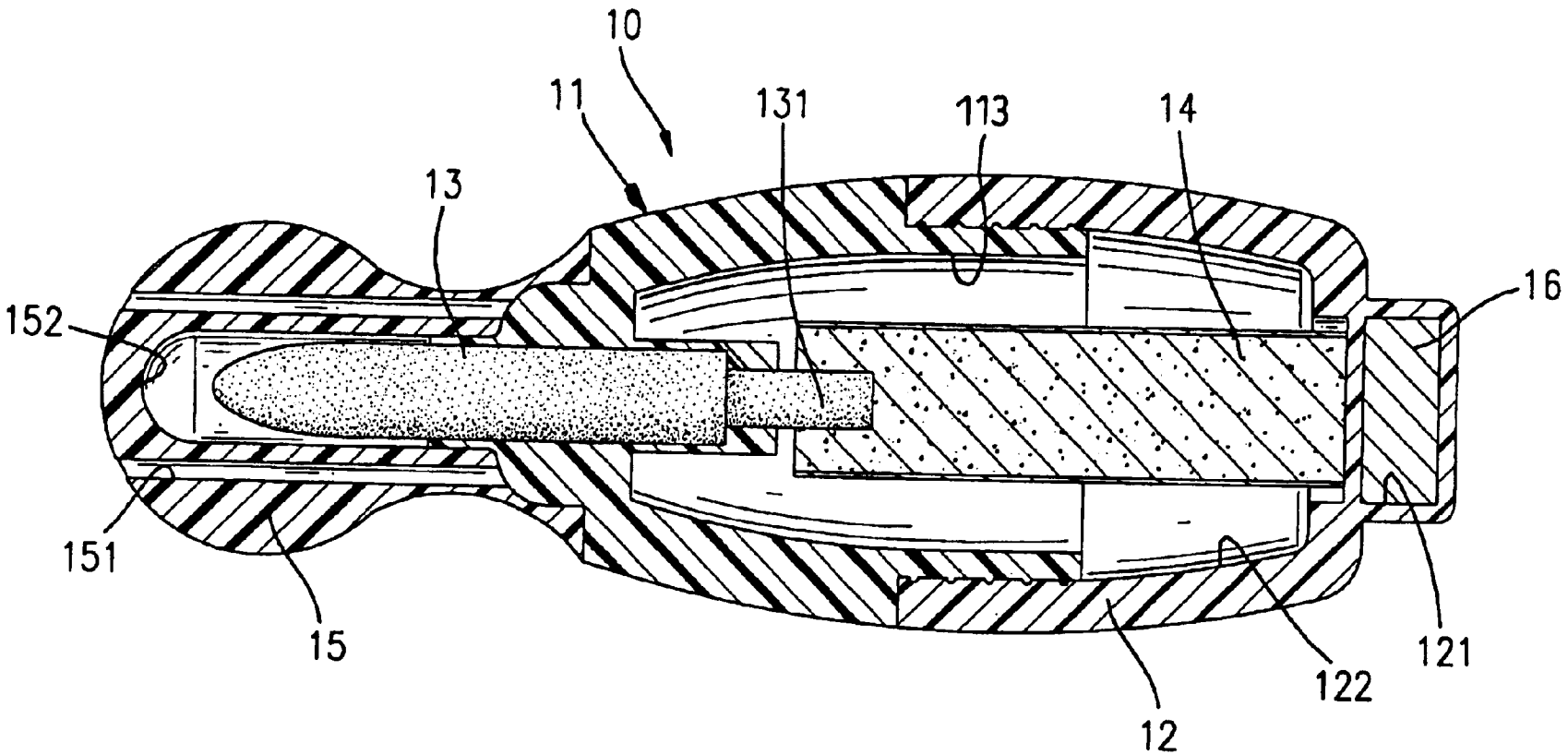
FIG. 3 is a side plan view in partial section of the white board marker in FIG. 1.
Figure 4:
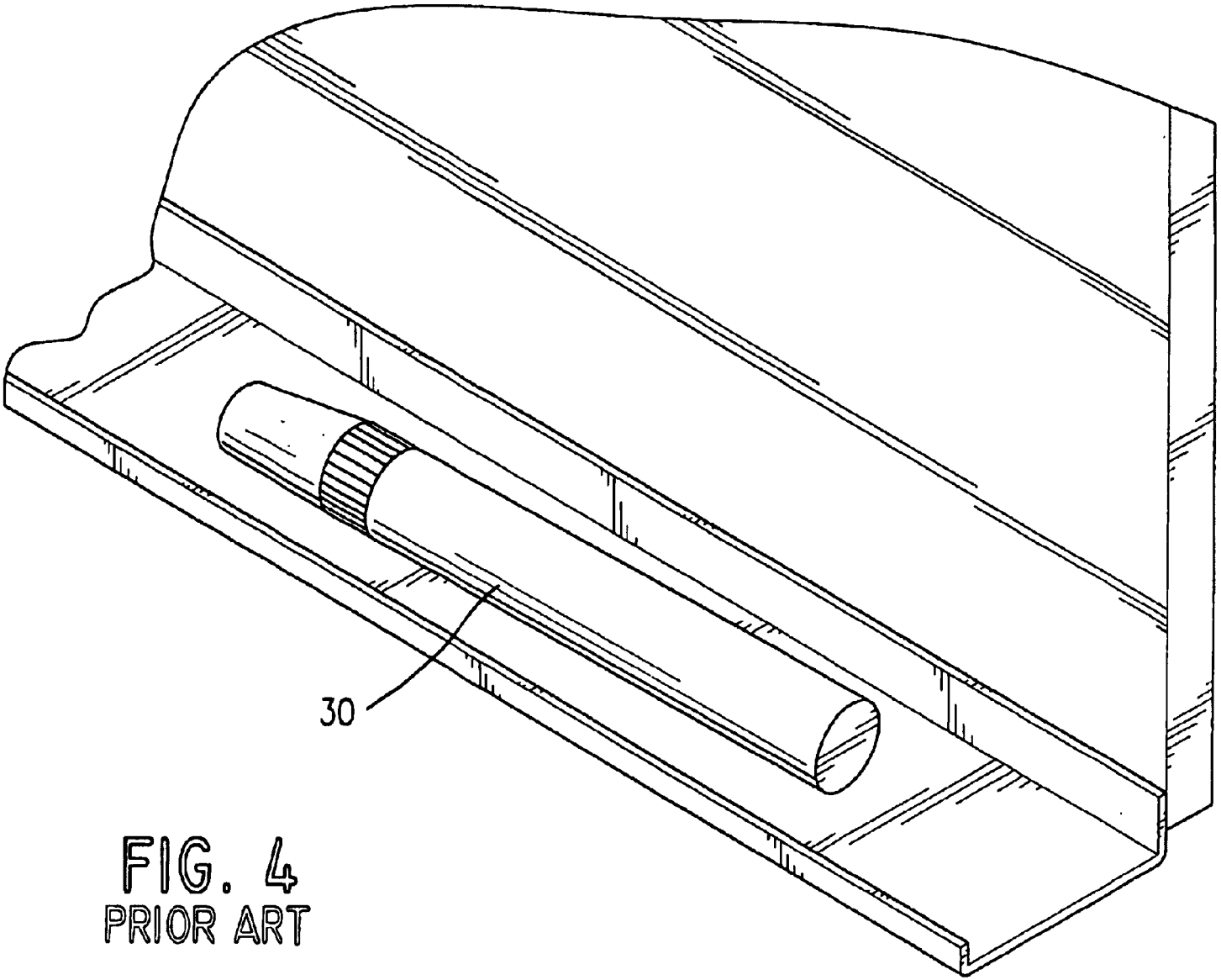
FIG. 4 PRIOR ART
FIG. 4 is a perspective view of a white board marker in accordance with the prior art.

With reference to FIGS. 1 to 3, a white board marker (10) has a cover (11), a body (12), a marker nib (13), an ink pad (14), a cap (15) and a magnet (16).

The cover (11) has a proximal end (not numbered), a distal end (not numbered), a side surface (not numbered), multiple ribs (111), a nib hole (112) and a front cavity (113). The multiple ribs (111) are formed on the side surface and used for preventing fingers from slipping off. The front cavity (113) is defined inside the rear end of the cover. The nib hole (112) defined inside the proximal end of the cover (11) and is communicated with the front cavity (113).

The marker nib (13) is mounted through the nib hole (112) of the cover (11) and has a tip (not numbered) and a refill end (131). The tip of the marker nib (13) extends out of the nib hole (112) and has a rear end (not numbered). The refill end (131) of the mark nib (13) is integrally formed with the rear end of the tip and is mounted inside the front cavity (113) of the cover (11).

The ink pad (14) abuts the refill end (131) of the marker nib (13) and extends into the front cavity (113) of the cover (11).

The body (12) is mounted on the rear end of the cover (11) and has a front end (not numbered), a rear end (not numbered), a magnet chamber (121) and a rear cavity (122). The magnet chamber (121) is formed at the rear end of the distal body (12). The rear cavity (122) is defined inside the body (12) and has an opening (not numbered) at the front end of the body (12). When the body (12) is mounted on the cover (11), the rear cavity (122) communicates with the front cavity (113) in the cover (11), and the ink pad (14) is mounted in the rear cavity (122) and the front cavity (113).

The magnet (16) is mounted inside the magnet chamber (121).

The cap (15) is mounted on the front end of the cover (1) and has a rear end (not numbered), a front end (not numbered), a neck (not numbered), multiple optional air passages (151) and a central cavity (152). The rear end of the cap (15) is mounted on the front end of the cover (11). The neck is formed around the cap (15) near the rear end of the cap (15) for convenient holding. The optional air passages (151) and the central cavity (152) are defined inside the cap (15). The central cavity (152) has an opening (not numbered) at the rear end of the cap (15). The optional air passages (151) extend completely through the cap (15). The central cavity (152) covers the tip of the marker nib (13) when the cap (15) is mounted on the front end of the cover (11).

To add attraction of the white board marker of the present invention, the cap (15) is shaped as a top of a bowling pin, and the cover (11) and the body (12) are shaped as a body of a bowling pin. So, when the cover (11) is mounted on the body (12) and the cap (15) is mounted on the cover (11), whole the white board marker (10) is shaped as a bowling pin.

When the white board marker (10) is not used, it can be attached to the white board by the magnet (16). Because the marker (10) is held on the white board, users will find the marker easily.

The optional air passages (151) are defined through the cap (15) so a person, especially a child, who gets the cap (15) caught in their throat can get air through the optional passages (151) until the cap (15) can be removed.

The white board marker in accordance with the present invention has the following advantages.

1. The appearance for the white board marker is attractive, and the 110 magnet (16) inside the white board marker can hold the marker (10) in place.
2. The optional air passages (15) defined through the cap (15) provide additional safety for children.

The invention may be varied in many ways by a person skilled in the art. Such variations are not to be regarded as a departure from the spirit and scope of the invention, and all such modifications are intended to be included; within the scope of the following claims.

What is claimed is:

1. A white board marker having a cover having a rear end, a front end, a cap at one end thereof, and a neck formed around the cap near a rear end thereof, a side surface, multiple ribs formed on the side surface, a front cavity defined inside the rear end of the cover, and a nib hole defined inside the front end of the cover and communicating with the front cavity, a marker nib mounted through the nib hole and having a tip extending out of the nib hole and having a rear end, and a refill end integrally formed with the rear end of the tip, a body mounted on the rear end of the cover and having a front end, a rear end, a magnet chamber formed at the rear end of the body, and a rear cavity defined inside the body and having an opening at the front end of the body, an ink pad abutting the refill end of the marker nib and received in the front cavity of the cover and the rear cavity of the body, a magnet mounted inside the magnet chamber for attaching the white board maker to a white board, and a cap mounted on the cover and having a front end, a rear end mounted on the front end of the cover, and a central cavity defined inside the cap and having an opening at the rear end of the cap to cover the marker nib.

2. The white board marker as claimed in claim 1, wherein the cap further comprises multiple air passages defined through the cap.

3. The white board marker as claimed in claim 1, wherein the cap is shaped as the top of a bowling pin, and the cover and the body are shaped as a body of the bowling pin to make board marker have a bowling pin shape.

* * * * *